United States Patent [19]

Rosenberg

[11] 3,977,949

[45] Aug. 31, 1976

[54] ACIDIC PLATING BATH AND ADDITIVES FOR ELECTRODEPOSITION OF BRIGHT TIN

[75] Inventor: William E. Rosenberg, Strongsville, Ohio

[73] Assignee: Columbia Chemical Corporation, Cleveland, Ohio

[22] Filed: July 7, 1975

[21] Appl. No.: 593,311

[52] U.S. Cl. ..... 204/54 R; 204/DIG. 2; 260/600 R

[51] Int. Cl.[2] ..... C25D 3/32

[58] Field of Search ..... 204/54 R, 54 L, 43 S, 204/DIG. 2; 260/600

[56] References Cited

UNITED STATES PATENTS

| | | | |
|---|---|---|---|
| 3,755,096 | 8/1973 | Passal | 204/54 R |
| 3,808,277 | 4/1974 | Alvarez | 260/600 X |
| 3,875,029 | 4/1975 | Rosenberg et al. | 204/43 S |

*Primary Examiner*—G. L. Kaplan
*Attorney, Agent, or Firm*—Oldham & Oldham Co.

[57] ABSTRACT

An aqueous acid tin electroplating bath contains as a brightening agent an alkoxy naphthalene carboxaldehyde, certain emulsifying agents and certain synergistically acting carboxylic acids, amides, and esters to give extremely bright electrodeposits.

25 Claims, No Drawings

ACIDIC PLATING BATH AND ADDITIVES FOR ELECTRODEPOSITION OF BRIGHT TIN

BACKGROUND OF THE INVENTION

The present invention relates to an aqueous acid electroplating bath for producing extremely bright, lustrous electrodeposits of tin.

Various brightener compositions for acid tin baths containing carboxaldehydes are disclosed in several United States patents. Depending upon the particular aldehyde utilized, the electrodeposits from acid sulfate tin plating baths can vary from dull or semi-bright to bright. The choice of aldehydes also determines a plating bath's ability to produce bright plate in extremely high current density areas as well as at low current densities, such as those encountered in recesses of irregularly shaped parts.

It has been found according to the present invention that certain highly active alkoxy naphthalene carboxaldehydes as primary brighteners can be used in much lower concentrations than previously used aldehydes to produce electrodeposits of tin from an aqueous acid plating bath that exhibit extreme luster and brightness over a very broad current density range.

SUMMARY OF THE INVENTION

Accordingly, it is an object of this invention to provide brightening agents which produce extremely bright electrodeposits of tin.

It is another object of the present invention to provide an alkoxy naphthalene carboxaldehyde as a brightening agent.

It is a further object of the present invention to provide a tin plating bath having an alkoxy naphthalene carboxaldehyde brightening agent which synergistically acts with carboxylic acids, amides, and esters to give extremely bright electrodepositions of tin over broad current density ranges.

It is yet a further object of the present invention to provide a tin plating bath, as above, wherein emulsifiers are utilized to disperse the brightening agent.

These and other objects of the present invention, together with the advantages thereof over existing prior art compounds and methods which will become apparent from the following specification, are accomplished by the compounds and methods herein described and claimed.

In general, a primary tin plating brightener comprises an alkoxy naphthalene carboxaldehyde of the following general formula:

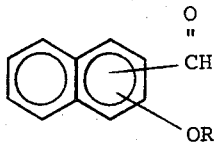

and

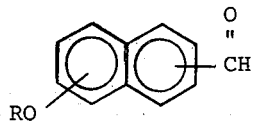

Where R is methyl, ethyl, propyl or isopropyl.

Additionally, an aqueous acid tin electroplating bath, containing stannous ions, and sulfuric acid, comprising having dissolved therein as a brightener compound about 0.01 to about 0.2 grams/liter and preferably from about 0.01 to about 0.05 grams/liter of an alkoxy naphthalene carboxaldehyde of the following general formula:

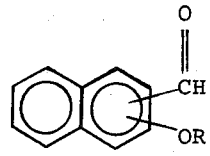

and

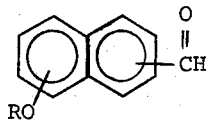

where R is methyl, ethyl, propyl, and isopropyl.

DESCRIPTION OF THE PREFERRED EMBODIMENTS

According to the concepts of the present invention, it has been found that very bright electrodeposits can be obtained from an aqueous acid tin plating bath when an alkoxy naphthalene carboxaldehyde compound is used as a primary brightener. It has been also found that these alkoxy naphthalene carboxaldehydes act synergistically with alpha unsaturated carboxylic acids, amides, and esters to produce extremely bright electrodeposits. The effect is truly synergistic in that the results obtained with this combination far exceed those of using the two types of compounds separately.

Many of the alkoxy naphthalene carboxaldehyde brighteners are available in commerce. The ones that are not can readily be prepared by one skilled in the art by chloromethylation of the appropriate naphthyl ether and conversion to the carboxaldehyde via the Sommelet reaction (See *Organic Chemistry*, Third Edition, by Feiser and Feiser . . . P. 677).

The alkoxy naphthalene carboxaldehydes of the present invention have the following general formula:

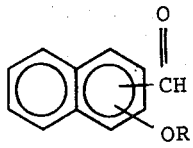

and

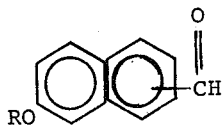

where R is methyl, ethyl, propyl, or isopropyl. Preferably, the carboxaldehyde group is located at the 1 or 2 position of the naphthalene compound. While all of the isomers exhibit brightening ability, the isomers that have the alkoxy group either ortho or para to the carboxaldehyde group, or a corresponding resonance position or the adjacent ring are the best brighteners. The reason that these preferred compounds produce increased brightness is thought to be due to ring activation through the resonance effect of the alkoxy group. Concerning the Ortho substituted aldehydes, it has been surprisingly found that they work as well as the para substituted aldehydes. In other plating systems, many ortho substituted isomers of active brighteners have a very limited effect compared to the para or meta substituted isomers. This is apparently caused by an ortho effect which either disrupts the neighboring functional group by an electronic interaction or by simple steric hindrance.

The very high activity of the alkoxy naphthalene carboxaldehyde brighteners allows them to be used in much lower concentrations than other carboxaldehydes. The brighteners of this invention are generally used at a concentration of about 0.01 to about 0.2 grams/liter and the preferred concentration is about 0.01 to about 0.05 grams/liter. They may be added to the bath in concentrated form or as dilute solutions in various suitable solvents such as methanol or ethanol.

Since these brighteners exhibit limited solubility in the plating bath, emulsifying agents generally must be used to disperse them. A brightener additive mixture may therefore contain the alkoxy naphthalene carboxaldehyde and from about 1 percent to about 96 percent by weight of the emulsifying agent based upon the total weight of the mixture. The types of emulsifiers or wetting agents that have been found to work quite well are listed in Table I. Depending upon the emulsifying ability of the particular emulsifying agent used, an amount in the range of about 2 to 40 grams/liter of plating bath is generally sufficient.

TABLE I

| TRADE NAME | TYPE | MANUFACTURER |
|---|---|---|
| Igepal CO-710 | Nonionic | GAF |
| Tergitol 08 | Anionic | Union Carbide |
| Miranol HS | Amphoteric | Miranol Chem. Co. |
| Amine C | Cationic | Ciba-Geigy |
| Tergitol TMN | Nonionic | Union Carbide |
| Avirol 100-E | Anionic | Standard Chem. Products, In. |

The preferred emulsifying agents have been found to be the nonionics made by condensing ethylene oxide with lipophilic groups such as long chain fatty alcohols, long chain fatty acids, long chain fatty amines, and long chain alkyl phenols the long chain containing from 6 to about 30 and preferably from 6 to about 20 carbon atoms. The optimum amount of ethylene oxide is about 10 to 20 moles per mole of lipophile. While these are the preferred nonionics, it is not meant to limit the invention to these types only. For example, ethylene oxide derivatives of naphthols and polysaccharides also perform satisfactorily. In addition, propylene oxide condensates also are considered part of this invention.

All of the alpha unsaturated carboxylic acids, amides, and esters generally are readily available in commerce. Table II lists the preferred compounds of this group.

TABLE II

Cinnamic acid
Acrylic acid
Methacrylic acid
Crotonic acid
Acrylamide
Methacrylamide
Methyl acrylate
Methyl methacrylate These alpha unsaturated compounds are generally added as aqueous or alcholic (e.g. methyl, ethyl, propyl and isopropyl alcohol) solutions to insure good dispersion in the plating bath. They are used at a concentration of about 0.02 to about 5 grams/liter and the preferred concentration is about 0.2 to about 2 grams/liter. These compounds may also be a part of a brightener agent mixture therefore containing the alkoxy naphthalene carboxaldehyde and from about 1 to about 97 percent by weight of the alpha unsaturated carboxylic acids, amides, and esters by weight of the total weight of the mixture. Of course, an emulsifying agent may also be added to this mixture wherein the amount of the emulsifying agent ranges from about 1 to 96 percent by weight based upon the total weight of the mixture.

Conventional addition agents known to the art such as aromatic and aliphatic ketones and aldehydes may be used in conjunction with the brighteners of this invention, but it has been generally found that they do not provide any additional brightening.

While the brightening agents of this invention are effective in many aqueous, acid tin plating bath formulations, it is preferred to use any of the basic baths described in the following examples. In general a source of stannous ions, such as stannous sulfate, is present. A suitable amount is from about 10 to about 100 grams per liter. Also present is sulfuric acid. A suitable amount is from about 20 to about 60 grams per liter.

EXAMPLE I

| BATH COMPOSITION | CONCENTRATION IN GRAMS/LITER |
|---|---|
| Stannuous sulfate | 35 |
| Sulfuric Acid | 100 |
| 4-methoxy-1-naphthaldehyde | 0.03 |
| Igepal CO-710 | 15 |
| Cinnamic Acid | 0.1 |

EXAMPLE II

| BATH COMPOSITION | CONCENTRATION IN GRAMS/LITER |
|---|---|
| Stannuous sulfate | 30 |
| Sulfuric acid | 180 |
| 2-methoxy-1-naphthaldehyde | 0.05 |
| Amine C | 20 |
| Methacrylic acid | 0.75 |

EXAMPLE III

| BATH COMPOSITION | CONCENTRATION IN GRAMS/LITER |
|---|---|
| Stannuous sulfate | 40 |
| Sulfuric acid | 200 |
| 4-methoxy-1-naphthaldehyde | 0.05 |
| Tergitol 08 | 10 |
| Tergitol TMN | 10 |
| Acrylic acid | 0.4 |

-continued

| BATH COMPOSITION | EXAMPLE IV CONCENTRATION IN GRAMS/LITER |
|---|---|
| Stannuous sulfate | 30 |
| Sulfuric acid | 180 |
| 2-methoxy-1-naphthaldehyde | 0.03 |
| Igepal CO-710 | 20 |
| Methacrylic acid | 0.75 |

| BATH COMPOSITION | EXAMPLE V CONCENTRATION IN GRAMS/LITER |
|---|---|
| Stannuous sulfate | 35 |
| Sulfuric acid | 180 |
| 4-methoxy-1-naphthaldehyde | 0.03 |
| Igepal CO-710 | 20 |
| Methacrylamide | 0.02 |

| | EXAMPLE VI |
|---|---|
| Stannuous sulfate | 30 |
| Sulfuric acid | 180 |
| 4-methoxy-1-naphthaldehyde | 0.03 |
| Miranol HS | 20 |
| Methacrylic acid | 0.75 |

All testing was done in a conventional 267 ml. Hull cell, using steel cathode panels and tin anodes. A current of two amperes was used for 5 minutes at temperatures ranging from 70°F to 85°F. The electrodeposits from the tests that were run on the baths of Examples I through V varied from bright to extremely bright. The best results were obtained from the baths of Examples I through VI. In these cases the bright ranges extended from about one ampere/sq. ft. to well over 100 amperes/sq. ft.

Table III discusses the results from Examples I through II in more detail along with additional tests conducted under the same conditions.

| ALPHA UNSATURATED COMPOUND | BRIGHTENER | EMULSIFIER | RESULTS |
|---|---|---|---|
| None | None | Igepal CO-710 | Dark and spongy higher than 40 amps./sq.ft. Dull from 0 to 40 amps./sq.ft. |
| None | 4-methoxy-1-naphthaldehyde | Igepal CO-710 | Dull to semibright from 1 to 90 amps./sq.ft. Very dull from 90 amps./sq.ft. |
| Cinnamic acid | 4-methoxy-1-naphthaldehyde | Igepal CO-710 | Bright from 3 to 100 amps./sq.ft. |
| Methacrylic acid | 4-methoxy-1-naphthaldehyde | Amine C | Extremely bright from 1 to over 100 amps./sq.ft. |
| Acrylic acid | 4-methoxy-1-naphthaldehyde | Tergitol 08 & Terrigitol TMN | Extremely bright from 1 to over 100 amps./sq.ft. |
| Methacrylic acid | 2-methoxy-1-naphthaldehyde | Igepal CO-710 | Extremely bright from 1 to over 100 amps./sq.ft. |
| Methacrylamide | 4-methoxy-1-naphthaldehyde | Igepal CO-710 | Extremely bright from 3 to 100 amps./sq.ft. |
| Crotonic acid | 4-methoxy-1-naphthaldehyde | Igepal CO-710 | Semibright from 0 to 16 amps./sq.ft. Bright from 16 to over 100 amps./sq.ft. |
| Methacrylic acid | 2-methoxy-1-naphthaldehyde | Miranol HS | Semibright from 0 to 12 amps./sq.ft., bright from 12 to 40 amps./sq.ft., and extremely bright from 40 to 100 amps./sq.ft. |
| Methyl acrylate | 4-methoxy-1-naphthaldehyde | Igepal CO-710 | Bright from 3 to over 100 amps./sq.ft. |
| Methacrylic acid | 4-methoxy-1-naphthaldehyde | Avirol 100-E | Semibright from 0 to 3 amps./sq.ft. and extremely bright from 3 to 100 amps./sq.ft. |

**All tests listed in this Table were run in a plating bath containing 30 grams of stannuous sulfate/liter and 180 grams of sulfuric acid/liter.

Having thus described this invention in such full, clear, concise, and exact terms as to enable any person skilled in the art to which it pertains to make and use the same, and having set forth the best mode contemplated of carrying out this invention in accordance with the Patent Statutes, the subject matter which is regarded as being my invention is particularly pointed out and distinctly claimed in what is claimed, it being understood that equivalents or substitutions for, parts of the above specifically described embodiment of the invention may be made without departing from the scope and concept of the invention as set forth in what is claimed.

What is claimed is:

1. A primary tin plating brightener additive, comprising an alkoxy naphthalene carboxaldehyde of the following general formula:

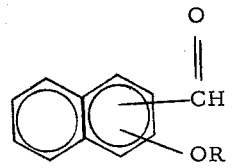

and

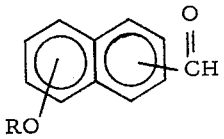

where R is methyl, ethyl, propyl, or isopropyl, and including from 1 to about 97 percent of at least one compound selected from the group consisting of alpha unsaturated carboxylic acids, amides, and esters for producing bright electrodeposits of tin from an aqueous, acid plating bath.

2. The additive of claim 1 including from about 1 to about 96 percent of at least one emulsifying agent selected from the group consisting of nonionic, cationic, anionic, and amphoteric emulsifying agents.

3. The additive of claim 2 wherein the emulsifying agent is a nonionic emulsifying agent.

4. The additive of claim 1 wherein R is methyl.

5. An aqueous, acid tin electroplating bath containing stannous ions and sulfuric acid, comprising having dissolved therein as a brightener compound about 0.01 to about 0.2 grams/liter of an alkoxy naphthalene carboxaldehyde of the following general formula:

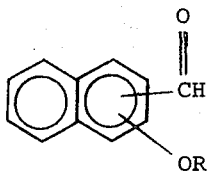

and

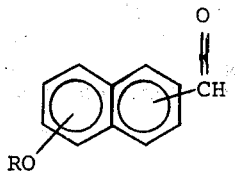

where R is methyl, ethyl, propyl, and isopropyl.

6. The bath of claim 5, wherein about 2 to about 40 grams/liter of an emulsifying agent is added to solubolize said alkoxy naphthalene carboxaldehyde.

7. The bath of claim 6, having dissolved therein about 0.02 to about 5 grams/liter of at least one compound from the group consisting of alpha unsaturated carboxylic acids, amides, and esters.

8. The bath of claim 7, wherein said alpha unsaturated compounds are selected from the group consisting of cinnamic acid, acrylic acid, methacrylic acid, crotonic acid, acrylamide, methacrylamide, methyl acrylate and methyl methacrylate.

9. The bath of claim 8, wherein said emulsifying agent is a nonionic emulsifying agent.

10. The bath of claim 8, wherein the emulsifying agent is an anionic emulsifying agent.

11. The bath of claim 8, wherein the emulsifying agent is a cationic emulsifying agent.

12. The bath of claim 8, wherein the emulsifying agent is an amphoteric emulsifying agent.

13. The bath of claim 8 wherein said emulsifying agent is selected from the group consisting of nonionic, anionic, cationic, and amphoteric emulsifying agents.

14. The bath of claim 8, wherein said emulsifying agent is an alkyl phenol condensed with about 10 to 20 moles of ethylene oxide per mole of alkyl phenol.

15. The bath of claim 8, wherein the alkoxy group on said naphthalene carboxaldehyde is ortho or para to the carboxaldehyde group.

16. The bath of claim 15, wherein said carboxaldehyde group is in the one position on the naphthalene ring.

17. The bath of claim 16, wherein R is methyl.

18. The bath of claim 15, wherein said carboxaldehyde group is in the two position of the naphthalene ring.

19. The bath of claim 18, wherein R is methyl.

20. The bath of claim 15, wherein R is methyl.

21. The bath of claim 15, wherein said carboxaldehyde group is in the one or two position on the naphthalene ring, and R is methyl.

22. The bath of claim 8, wherein the amount of said carboxaldehyde ranges from about 0.01 to about 0.05 grams/liter.

23. The bath of claim 8, wherein the amount of alpha unsaturated compounds ranges from about 0.02 to about 2.0 grams/liter.

24. The bath of claim 8, wherein the amount of stannous ions ranges from about 10 to about 100 grams/liter.

25. The bath of claim 8, wherein the amount of sulfuric acid ranges from about 20 to about 60 grams/liter.

* * * * *